United States Patent [19]

Kash

[11] Patent Number: 4,701,951

[45] Date of Patent: Oct. 20, 1987

[54] ACOUSTIC IMAGER

[76] Inventor: Albert Kash, 8307 Lages La., Baltimore, Md. 21207

[21] Appl. No.: 840,153

[22] Filed: Mar. 17, 1986

[51] Int. Cl.[4] ..... H04R 5/00; H04R 1/02

[52] U.S. Cl. ..... 381/24; 381/90; 181/155

[58] Field of Search ..... 181/155, 175, 199; 381/24, 88, 89, 90

[56] References Cited

U.S. PATENT DOCUMENTS 4,031,318 6/1977 Pitre ..... 181/155

OTHER PUBLICATIONS

Electronics, Dec. 1970, p. 137, "Wharfedale Variflex", Stereo Speakers.

Dbx Soundfield One Speaker System, Stereo Review, Jul. 1984, pp. 56–59, 86.

*Primary Examiner*—Forester W. Isen

*Attorney, Agent, or Firm*—Robert E. Bushnell

[57] ABSTRACT

An improved stereophonic imaging system with two stand-alone cabinet units 10, 12 each having a front baffle with sound emitting bass midrange B1, B2 and tweeter T1, T2 drivers symmetrically arranged about a common vertical plane to emit directly radiated sound. Individual panels 30, 32 with cylindrical, convex reflecting surfaces 34, 36 are disposed with their axes parallel to the common plane at variable distances from and at variable angular orientations to the common plane, to redirect energy emanating from the transducers as reflected secondary sound. The reflected sound blends together with directly radiated sound to provide a coherent central image with improved definition and fidelity.

23 Claims, 12 Drawing Figures

ACOUSTIC IMAGER

TECHNICAL FIELD

The present invention pertains to acoustic systems generally and, more particularly, to stereophonic imaging sound reproduction systems.

BACKGROUND ART

As explained in Torffield, U.S. Pat. No. 4,190,739, sound reproduction systems using passive, reflective surfaces in addition to active sound sources such as speakers are not unknown. The terms "speaker" and "oudspeaker" mean either a single sound source or a system of several sources, each contributing a part of the audible frequency range. In the past, individual speaker enclosures have employed reflective elements internally to direct sound in one direction or another. Speakers have been suggested for directing sound against nearby structural walls to cause reflection of the sound back towards a listening area. Sounding boards are known for use by instrumentalists to project sound either towards an audience's listening area or towards studio microphones. Various architectural acoustic elements have been employed or suggested for enhancing the acoustical characteristics of auditoriums.

In high fidelity sound reproduction systems however, the use of non-architectural sound reflectors spaced from a speaker to redirect sound towards a listener has been relatively unexploited. The loudspeaker industry has, for example, made attempts over several years to provide the listener with a kind of sound experience otherwise attainable only under real-life conditions. The familiar stereophonic loudspeaker systems have been commercially successful because, in comparison with monaural loudspeakers, sterophonic systems went a long way towards providing realistic sound experiences. Insofar as is known however, the prior art has not been able to provide a system which subjects a listener to the feeling of acoustical space, depth and scale which, in an almost inexplicable way, characterizes real-life live sound.

Such attempts have included sterophonic loudspeaker systems with two identical speakers pointed toward convexly curved surfaces for purposes of distributing the sound while eliminating the well known "beaming" effect inherent in sound emanating from speakers more or less equivalent to point sources. An example of such attempts is disclosed in Ranger, U.S. Pat. No. 3,065,816. Reflective arrangements have been proposed for low frequency sound components; it is generally conceded however, that such arrangements have produced an undesirable, blurred sound reproduction.

An interesting example of the use of reflection in an attempt to provide more realistic sound is shown by Karlson, U.S. Pat. No. 2,896,736 which proposes the use of a loudspeaker in an especially designed enclosure. In Karlson, a loudspeaker is pointed towards a wall to obtain greater angular dispersion of the sound than the typical ninety degree to one hundred and twenty degree sound dispersion characteristic of conventional conical loudspeakers radiating directly into an air space. Karlson suggests the use of curved surfaces to permit projection of sound over considerable distanced with minimal losses by reflecting the sound emanating from the specially enclosed loudspeaker via elliptical, hyperbolic and other curved surfaces.

The quality of reproduction which a loudspeaker provides within a room is known to be influenced by the interaction of the loudspeaker with adjacent reflecting boundary surfaces of the room, and especially by the sound reflected from any wall behind the loudspeaker. Sound reflected from such a wall arrives substantially in phase at very low frequencies, thereby increasing the efficiency of the loudspeaker within the low frequency range. The interaction of the sound emanating from the loudspeaker with adjacent walls however, causes an uneven frequency response known as the "comb filter effect." This effect occurs because the phase angle between the direct sound emanating from the loudspeaker and the sound reflected from the adjacent walls of the room is proportional to frequency, and the resulting sound at higher frequencies will alternate between minimum and maximum amplitudes. The first minimum usually occurs between 100 and 300 Hertz, depending upon the distance of the sound radiating surfaces from the wall. The reflected sound component distorts not only the amplitude response of the loudspeakers in the frequency domain, but also their amplitude response in the time domain.

Although roughened or irregular surfaces have been used in the acoustic arts, little attention has been given to the effects of the surface of a reflector. Wherever roughened or irregular surfaces have been used, such surfaces have been associated with sound absorption, rather than with sound reflection. The dispersive effect of roughened or irregular surface textures has been largely ignored in sound reproductive systems. In the reproduction of sound in currently available systems, a recurring phenomena has been differences in the angles of dispersion of the sound at various frequencies across the audible spectrum. Ordinarily, bass frequencies are more widely dispersed while the higher audio frequencies are more narrowly dispersed. This characteristic is called "beaming" by virtue of the narrower or beam-like projection of cones at higher frequencies.

STATEMENT OF THE INVENTION

Accordingly, it is an object of the present invention to provide an improved acoustic imaging system.

It is another object to provide an acoustic imaging system characterized by improved control over directivity.

It is yet another object to provide a stereophonic acoustic imaging system for controlling an acoustic environment.

It is still another object to provide a stereophonic acoustic imaging system minimizing the reflection of sound from architectural members throughout substantially the entire frequency range reproduced.

It is still yet another object to provide a stereophonic acoustic imaging system for minimizing "beaming" effects.

It is another object to provide a stereophonic acoustic imaging system having the ability to minimize "comb filter effects."

It is a further object to provide a stereophonic acoustic imaging system exhibiting an enhanced transient response.

It is a yet further object to provide an inexpensive stereophonic acoustic imaging system.

It is a still further object to provide a stereophonic acoustic imaging system producing a sharply defined central image.

It is still yet a further object to provide a stereophonic acoustic imaging system which gives a listener enhanced sound perception by more precisely localizing musical instruments.

It is another object to provide a stereophonic acoustic imaging system furnishing a listener with greater sound perception while the listener is in a normally seated position.

It is an additional object to provide a system for defining the width and depth of a sound stage with greater definition.

These and other objects are achieved in a stereophonic sound system using a pair of enclosures positionable in spaced-apart configurations with a pair of electro-acoustic transducers operable over a common frequency range, symmetrically mounted in each of the enclosures. Individual panels providing on one side convex reflecting surfaces shaped as sectors of cylindrical arcs, are positioned with their axes vertically disposed parallel to a plane of symmetry about which each corresponding pair of transducers is arranged, and at variable distances from and angular orientations to that plane. This enables each panel to be individually positionable with an orientation of their reflective surfaces relative to the corresponding pair of transducers to simultaneously redirect energy emanating from both transducers.

A circular torus having a diameter approximately equal to the outer circumference of the dome in the electro-acoustic transducer reproducing the higher frequency ranges may be positionable around and very slightly off-axis of the dome to enhance the directivity of the system across the higher frequency range. If made of a ferric material, the ring may be held in place by the magnetic core of the associated transducer.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

By radiating overlapping portions of a frequency spectrum from two transducers that are physically separated, it is possible to create in a listener an impression of a single broad source located somewhere between the two transducers. Since music generally contains a broad band signal, the apparent single broad source is constantly perceived by the listener as being in motion. The listener is however, unable to localize the sound as emanating from any particular point; consequently, the listener perceives the sound as originating from a wide source. The combination of these effects produces a loudspeaker with a wide spatial image.

Figure 1:
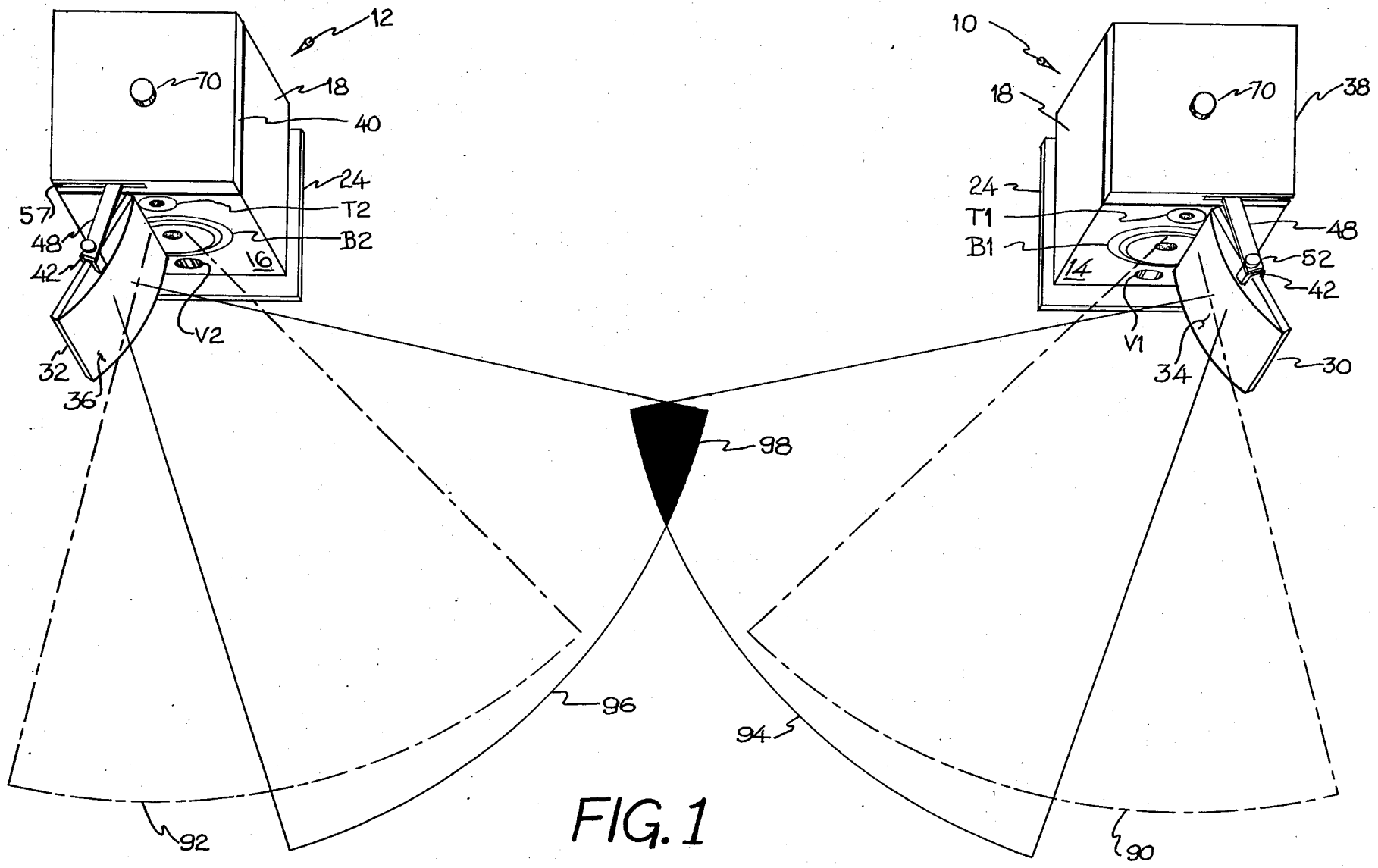
FIG. 1 is an overhead, perspective view showing one embodiment made according to the principles of the present invention.
Figure 2:
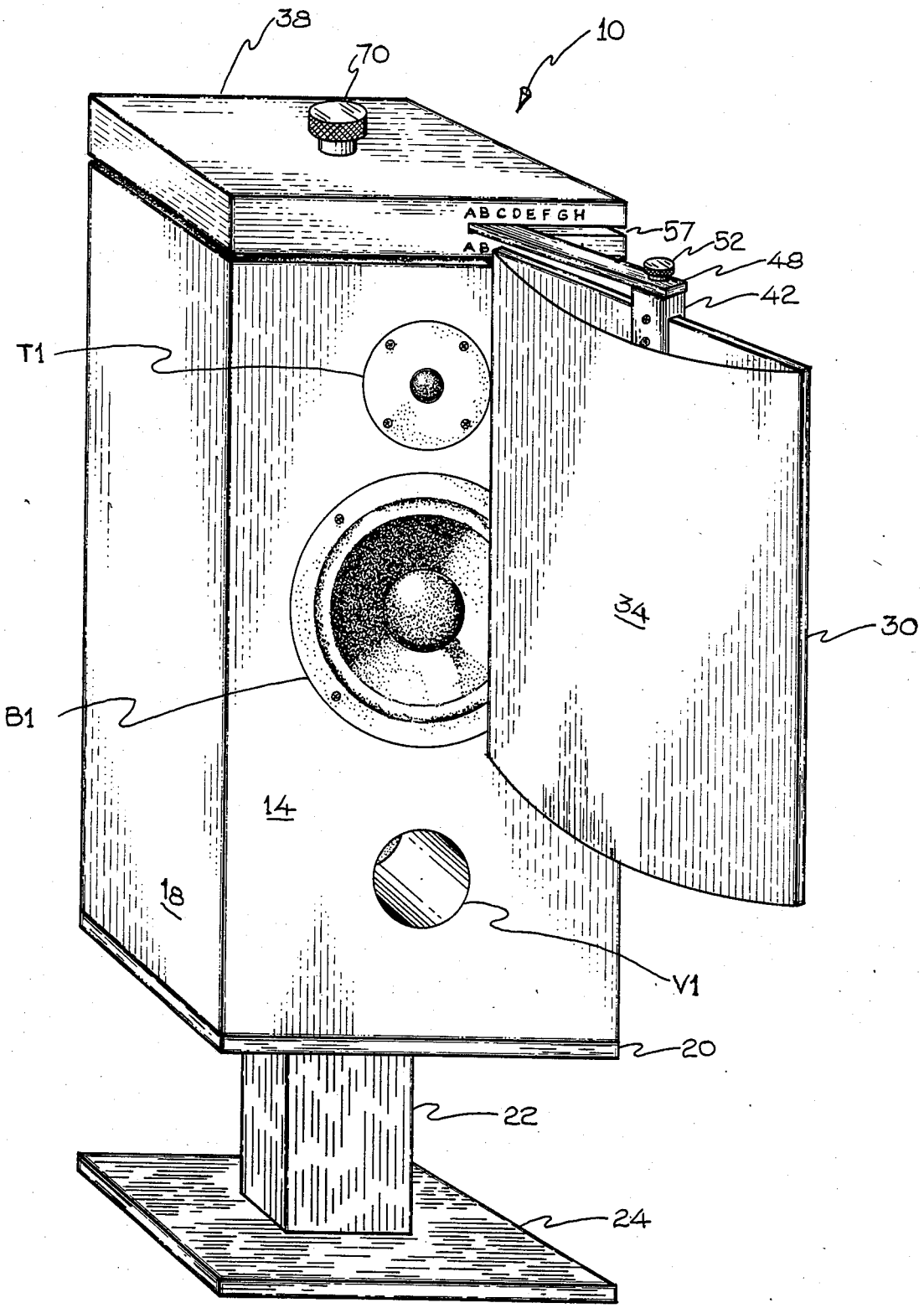
FIG. 2 is an orthagonal projection showing details of one of the units shown in FIG. 1.

Referring now to the drawings, FIG. 1 shows two loudspeaker units 10, 12 positioned in a spaced apart configuration as, for example, towards opposite sides of a room, for providing an improved stereophonic acoustic image system according to the principles of the present invention. As shown in greater detail in FIG. 2, each unit 10, 12 includes a tweeter driver T1, T2, a bass midrange driver B1, B2 and a vented port V1, V2, respectively centered in vertical symmetry along one face 14, 16 of each unit with each tweeter positioned above the corresponding bass-midrange driver and each vented port disposed below the corresponding midrange driver.

In addition to their front faces 14, 16, each unit 10, 12 is constructed as a vented cabinet enclosure with three other sides 18 of substantially similar characteristics. Each cabinet unit contains an upper (not visible) and lower horizontal side (not visible) substantially enclosing the cabinets. Each cabinet unit rests upon a pedestal having an upper horizontal member 20 constructed to the same width and depth as the cabinet, thereby facilitating location of the cabinet directly over the center of the pedestal. A post 22 is disposed between horizontal member 20 and a base plate 24 to maintain the cabinet in a vertically errect position. Each cabinet is approximately 24 inches in height, 12½ inches in width and 12 inches in depth while the pedestal is eight inches in height, to give an overall cabinet height of 32". Accordingly, when disposed in the positions shown in FIGS. 1 and 2, tweeter drivers T1, T2 are located on a horizontal centerline about 28½ inches from the floor, or underside of base plate 24, while the bass midrange drivers B1, B2 are located on horizontal centerlines about 21 inches from the floor. This arrangement assures that the drivers are at "ear level" for a seated listener. The pedestal uncouples bass frequencies from the underlying floor, thereby pproviding better bass definition, while raising the drivers to provide the listener with line-of-hearing listening and minimizing unwanted reflections of emanating sound from the floor.

Figure 3:
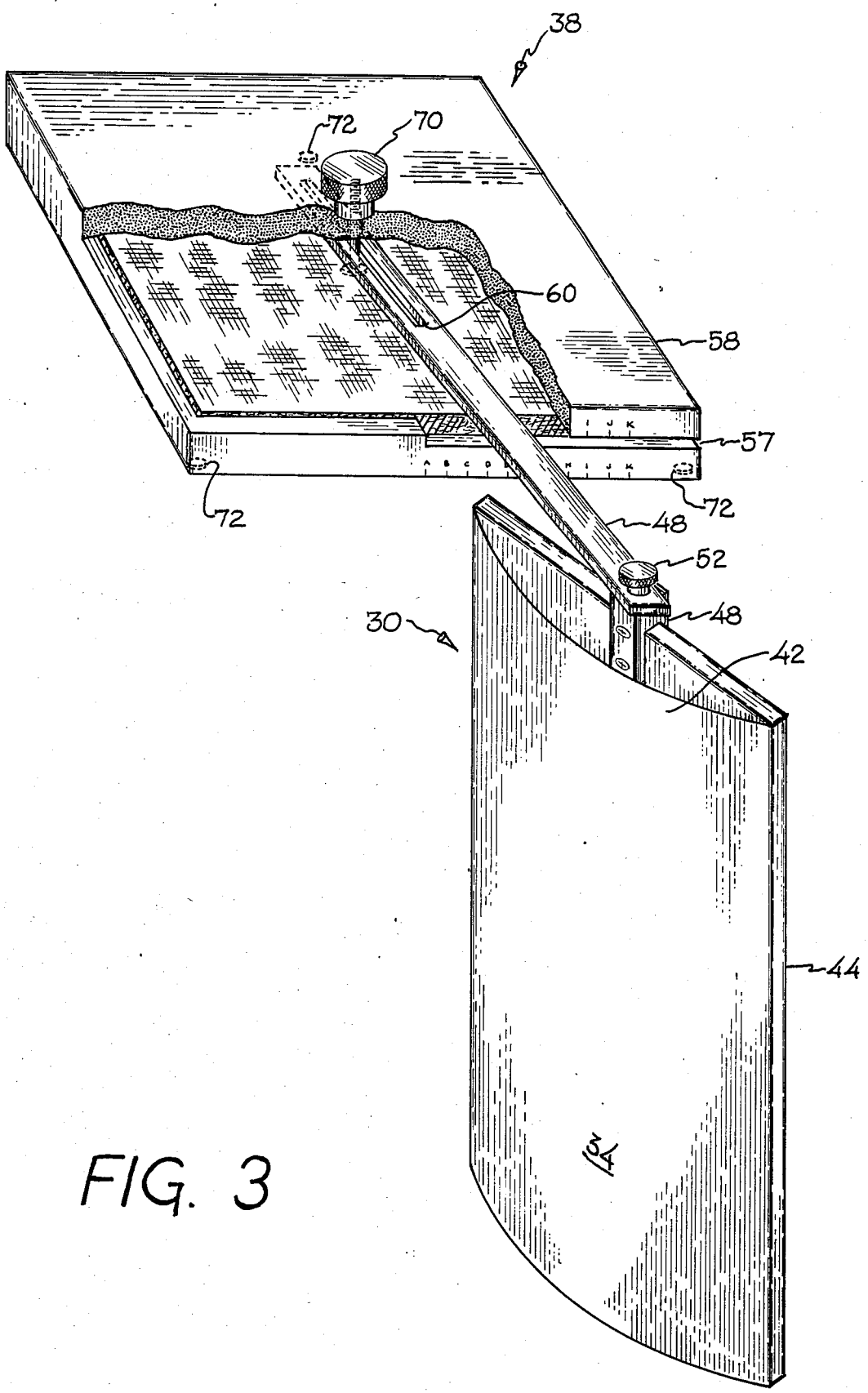
FIG. 3 is an orthagonal projection showing one panel and a partically cut-away view of the panel positioning assembly.
Figure 4:
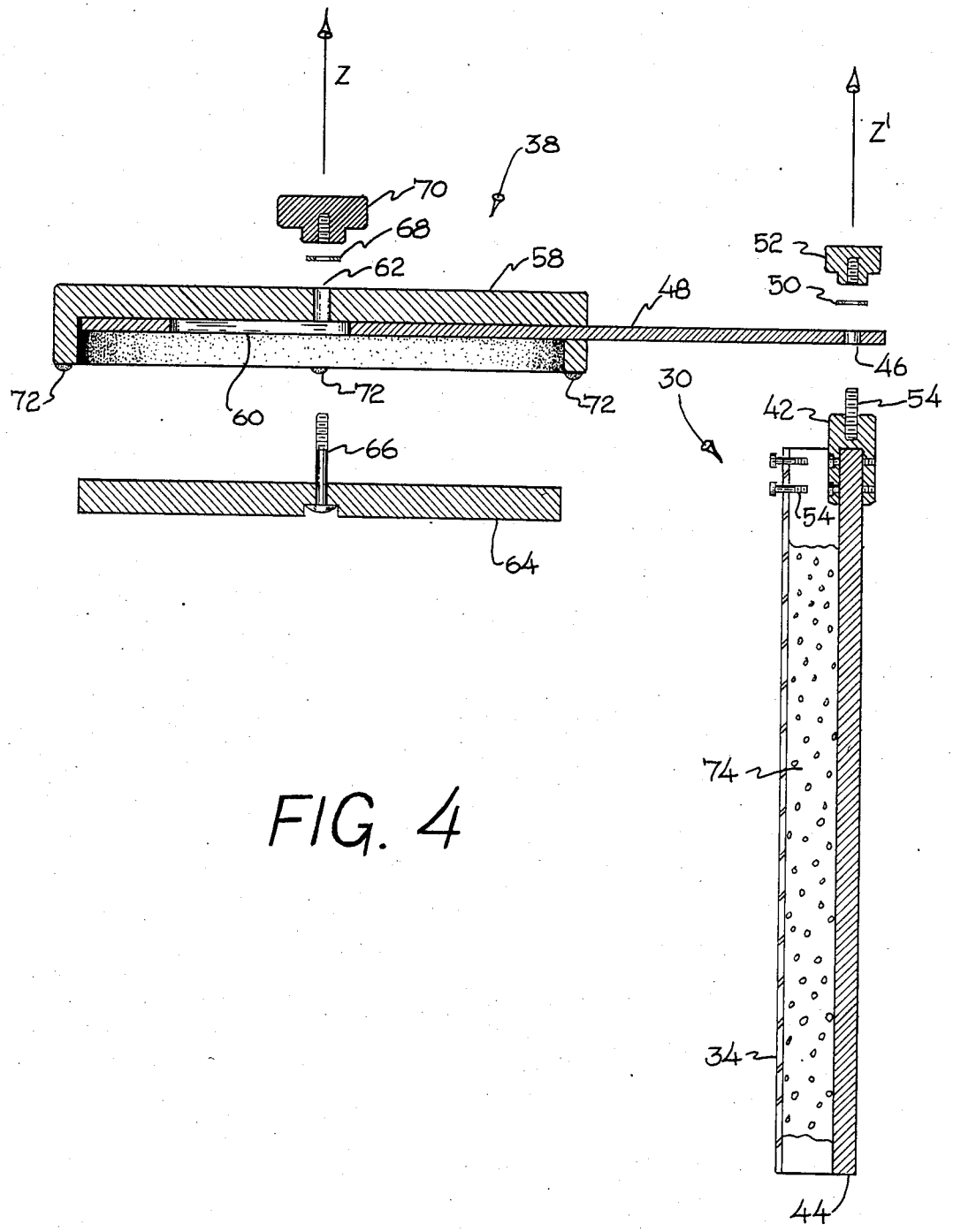
FIG. 4 is an exploded cross-sectional view of the panel, the panel positioning assembly and the associated hardware.

Panels 30, 32 each providing a convex reflecting surface 34, 36 respectively, are suspended in front of cabinet faces 14, 16 by adjustable positioning assemblies 38, 40. FIGS. 3 and 4 illustrate a panel 30 and its positioning assembly 38 in greater detail. Reflecting surfaces 34, 36 are convex and formed as sectors of substantially cylindrical arcs having approximately a one foot radius. Reflecting surfaces 34, 36 are preferably made of a dense material with an undulating or contoured and roughened surface texture to achieve greater dispersion of sound. The Nevamar brand slate high pressure laminate is one commercially available material for constructing surfaces 34, 36. Panels 30, 32 are approximately 11 inches in width and 18 inches in length to assure redirection of substantially all sound emanating directly from the tweeter and bass-midrange drivers as well as sound components intermediately reflected from those portions of cabinet faces 14, 16 adjacent to convex surfaces 34, 36. As shown in the six coordinate representation of FIG. 5, as well as in FIGS. 1–4, panels 30, 32 are each suspended along a vertical axis z′ which is parallel to and symmetrically arranged with the reflecting surfaces 34, 36 by a bracket 42 connected to a vertical member 44 forming a planar back surface for each of the panels. A vertically disposed connector such as stud 46 protrudes upward from brackets 42 along the z′ axis, through an aperture 46 in a bar 48, and through a washer 50 to meet with a retaining element such as a knurled nut 52. Fasteners such as bolts 54 connect bracket 42 to member 44. It may be seen from the figures therefore, expecially FIGS. 4 and 5, that this arrangement allows panels 30 to be adjustably oriented through 360 degrees of rotation about the z′ axis.

Bar 48 extends through a continuous slot 57 extending partially along two sides of a housing 58 and into the interior of housing 58. In this arrangement, that portion of bar 48 within housing 58 substantially joins the interior horizontal surface of the housing. An elongate slot 60 in that portion of bar 48 disposed within housing 58 is slidably positionable adjacent an aperture 62 extending vertically through the horizontal surface of housing 58. A rectangular plate 64 made of a relatively dense material such as compressed particle board, is shaped to fit within the interior of housing 58 along the underside of bar 48. Aperture 62 is located substantially at the center of the upper horizontal surface of housing 58, coaxial with the z axis shown in FIG. 5 to serve as a point of reference, or origin, of the x, ly, z coordinate system. A fastener such as bolt 66 extends vertically along the z-axis through slot 60, aperture 62, annular washer 68 and meets with a receiving fastener such as knurled nut 70.

Figure 5:
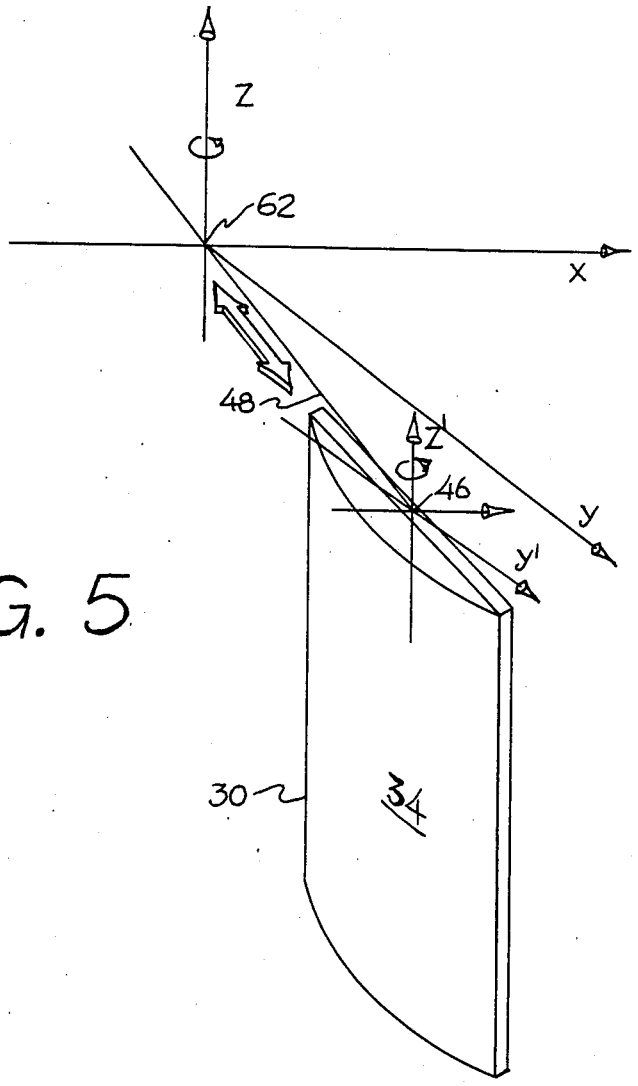
FIG. 5 is a three orthagonal axis illustration of the disposition of a panel relative to a pair of transducer elements mounted in a single enclosure.

When the distal end of bolt 66 is loosely engaged in nut 70, rectangular plate 64 drops free due to the clearance provided by pads 72, and slot 60 enables bar 48 to slidingly reciprocate relative to the points of origin 46, 62 of the x, y, z and x′, y′, z′ coordinate system shown in FIG. 5. However, when the distal end of bolt 66 is tightly drawn into nut 70, the upper and lower horizontal surfaces of bar 48 are clamped between the underside of housing 56 and the upper surface of plate 64, thereby not only preventing bar 48 from sliding along the line connecting points of origin 46, 62, but effectively dampening vibrations of bar 48.

As best shown in FIG. 3, slot 57 not only accommodates (in conjunction with slot 60) reciprocal movement of bar 48, but the rotation of bar 48 about bolt 66 and the z′ axis. It may be noted that positioning assemblies 38, 40, with their oppositely oriented slots 57, are mirror image assemblies; of course assemblies 38, 40 may be identically constructed as interchangeable items with identical slots. The rectangular shape of housing 58 conforms to the dimensions of the cabinets of units 10, 12, thereby allowing assemblies 38, 40 to rest upon the upper horizontal surface of each unit. Rubber pads 72 along the underside edges of housing 58 level the housings and provide three points of contact separating the housings from the cabinets of each unit.

Panels 30, 32 are constructed with a substantially hollow interior, thereby assuring that the significantly greater mass of positioning assemblies 38, 40 enables bars 48 to serve as cantilevers holding panels 30, 32 in static equilibrium while vertically suspended in front of the tweeter and midrange drivers without risk of unseating assemblies 38, 40 from the tops of the cabinets. Although the materials from which convex reflecting surface 34, 36 are formed exhibit very low resonant frequencies, to prevent vibrations of surface 34, 36 lengths of a lightweight cellular or foamed material 74 may be compressed and placed between member 56 and the respective surfaces 34, 36, thereby not only avoiding vibrations of the reflecting surfaces but preserving the substantial differences in mass between the panels and their positioning assemblies. The upper and lower horizontal sectors of the panels should be closed.

Turning again to FIG. 5, it is apparent that the foregoing arrangement allows each panel to be vertically positioned along an axis, z′, parallel to a common vertical plane defined by the y-z axes, about which the tweeter and base midrange transducers are symmetrically positioned, with three degrees of freedom. Accordingly, the positioning assemblies enable the axis of each panel to be disposed at variable distances from and at variable angular orientations to the common plane and the transducers bisected by the common plane. Consequently, each panel is individually positionable with an orientation of its reflective surface relative to the corresponding pair of transducers T1, B1 and T2, B2 to simultaneously redirect energy emanating from the respective pair of transducers. Ideally, and as shown in FIG. 1, horizontal tangents at the midpoints of surfaces 34, 36 form an angle of about thirty degrees with the respective common y-z planes of units 10, 12. It may be noted however, that the lower horizontal edges of panels 30, 32 are substantially above the orifice of vented ports V1, V2 to prevent interaction with emitted bass frequencies.

Figure 6:
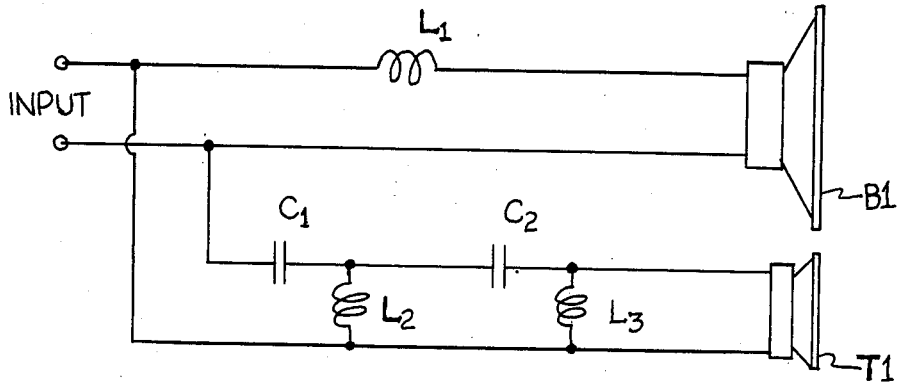
FIG. 6 is a schematic representation of a cross-over circuit suitable for use in embodiments of the present invention.
Figure 7:
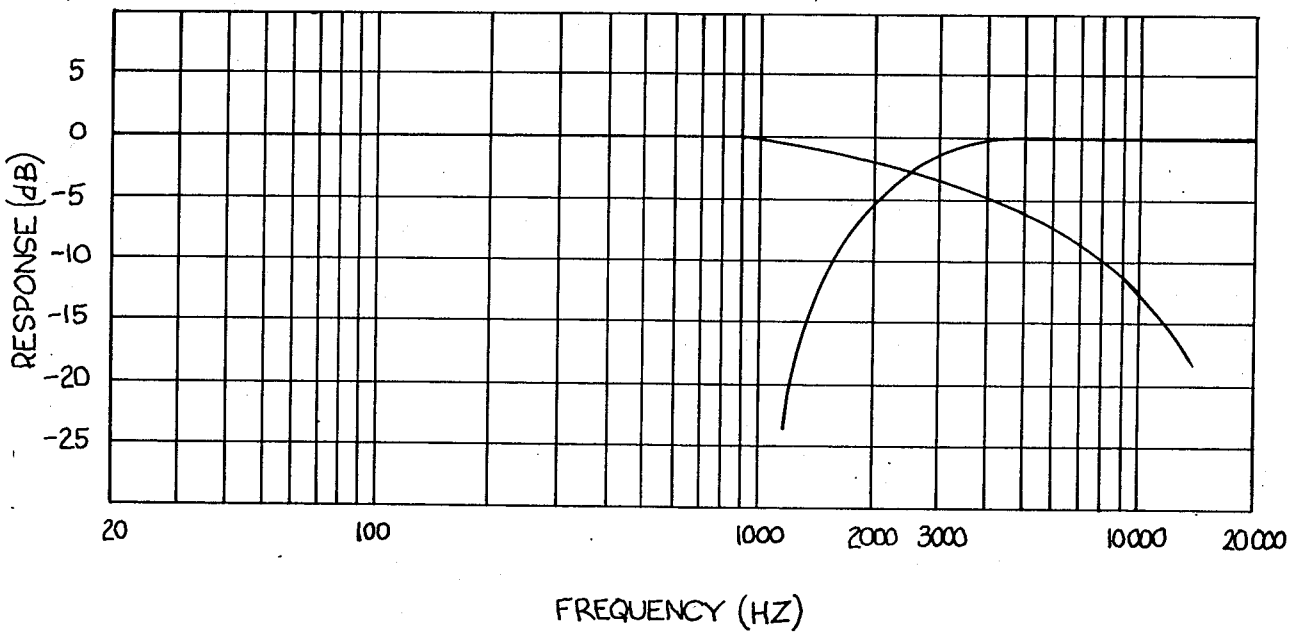
FIG. 7 is a two coordinate graph illustrating the performance in the cross-over region of midrange and tweeter transducers used in the embodiment of FIG. 1.

FIG. 6 is a schematic representation of one crossover network suitable for use with embodiments of the present invention, together with the loudspeakers B1, T1, coupled to the right channel. Bass midrange transducer B1 is coupled directly across the right channel, in series with inductance, L1 while tweeter transducer T1 is coupled in parallel with a ladder formed by capacitance C1 and inductance L2, and capacitance C2 and inductance L3. An identical crossover network may be used to couple bass midrange transducer B2 and tweeter T1 across the left channel. All of the transducers are commercially available items; bass midrange transducers B1, B2 may for example, be 210 mm. diameter, 8 ohm devices while tweeter transducers T1, T2 may be 25 mm. diameter, 8 ohm devices. As represented by the graph in FIG. 7, this arrangement produces a frequency response which is substantially linear to beyond 2.5 kiloHertz, characterized by a crossover point at approximately 2.5 kiloHertz.

Figure 9:
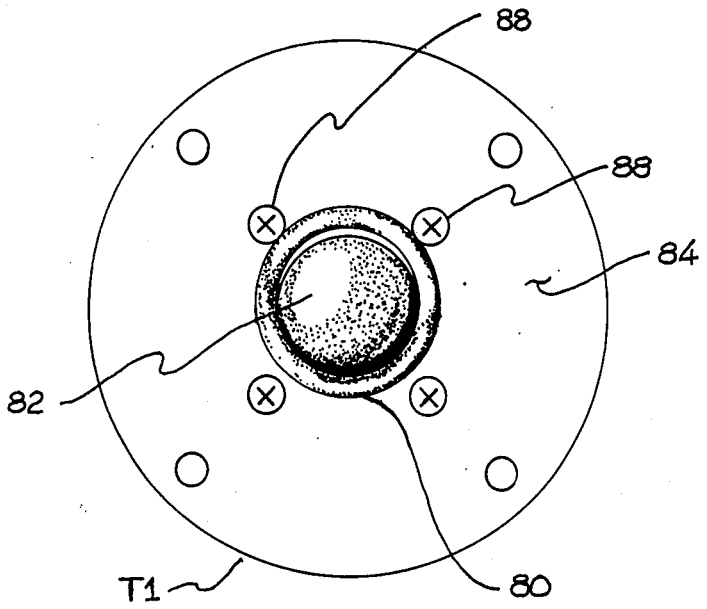
FIG. 9 is a front view of the embodiment of FIG. 8.
Figure 8:
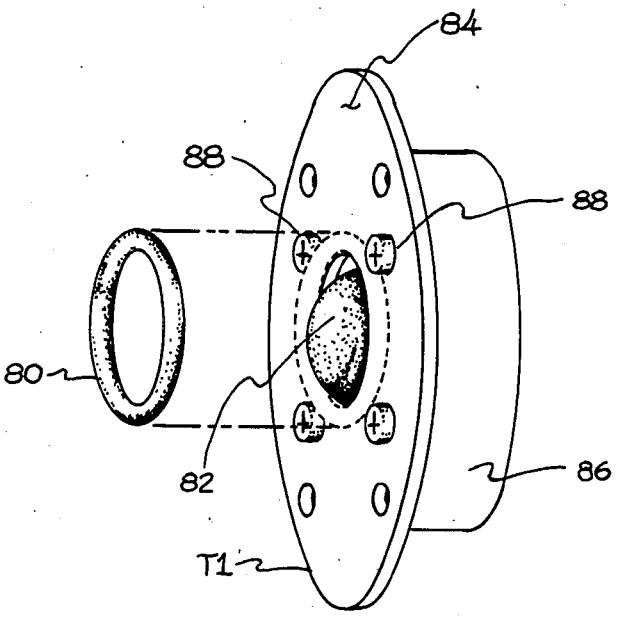
FIG. 8 is a partially exploded, orthagonal projection of a tweeter transducer modified according to the principles of the present invention.

FIGS. 8 and 9 show an alternative embodiment of the foregoing inventions in which a circular toroid 80 having an inner diameter approximately equal to the dome 82 of tweeter transducer T1 is placed around dome 82 upon the face plate 84 of the transducer. Toroid 80 has a thickness of approximately one-eighth of an inch, and if made a ferrous material may be held in place on face plate 84 by the annular magnet 86 of transducer T1. Limiting members such as screws 88 extending above the surface of face plate 84, hold toroid 80 substantially coaxially centered with dome 82. It should be noted however, that limiting members 88 should be provide a very slight tolerance of approximately one-sixteenth of an inch to allow toroid 80 to be shifted slightly off-axis with respect to dome 82.

Figure 10:
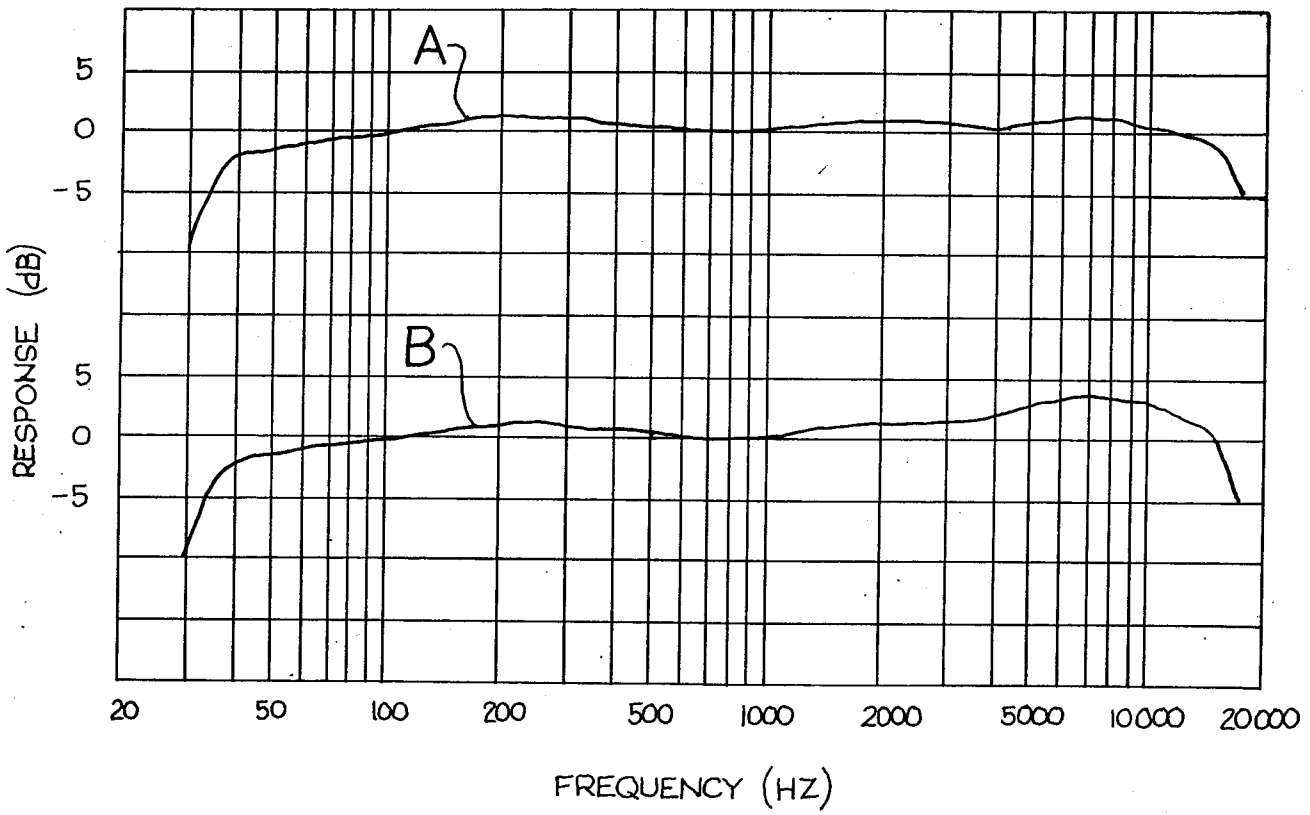
FIG. 10 is a two coordinate graph showing the frequency responses of one unit of the present invention both with, and without, the modifications shown in FIGS. 8 and 9.

When centered coaxially with the longitudinal axis of dome 82, loudspeaker unit 10 provides an improved directivity of the high frequency ranges emanating from the tweeter transducer. Curve A in FIG. 10 illustrates the frequency response of a single loudspeaker unit 10 over the entire frequency spectrum reproduced, without the presence of toroid 80. Curve B in FIG. 10 however, represents the frequency response measured over the entire frequency spectrum reproduced with toroid 80 present, but positioned slightly to the left of center of the longitudinal axis of dome 82. By shifting the axis of toroid 80 to the left of the center of the longitudinal axis of dome 82, sound emanating from tweeter T1 is directed towards the left of unit 10. This phenomenon is represented in curve B by an approximately 1 to 2½ decibel increase in the sound pressure level measured between 2.5 and 10 kilo Hertz. It may be noted that the amplitude-frequency response measurements represented in curves A and B of FIG. 10 were average room acoustic readings obtained with a Scott Model 83OZ audio analyzer using an 80 decibel reference level and the C scale of the Warble tone generator.

Figure 11:
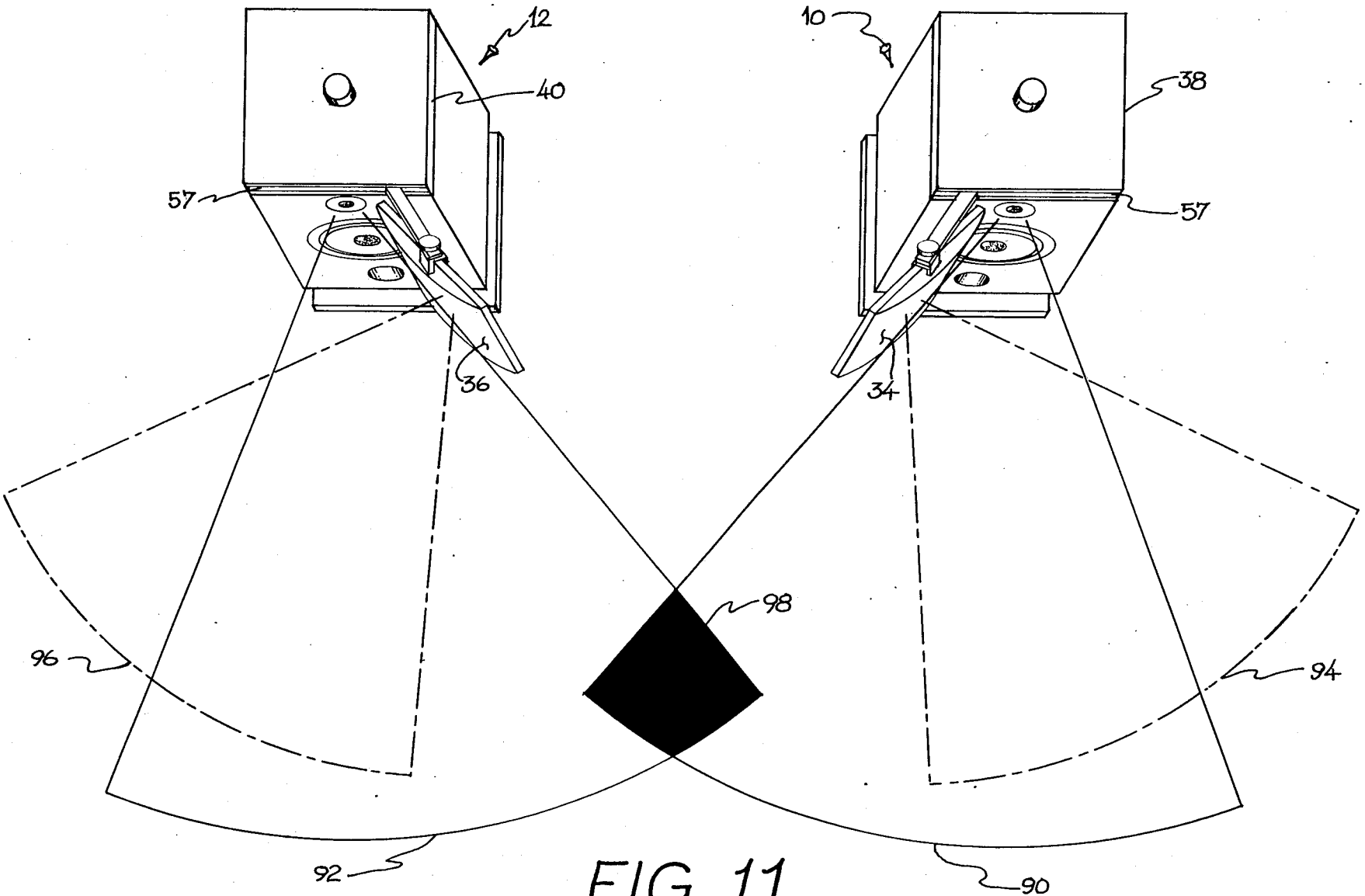
FIG. 11 is an overhead, perspective view showing an alternative embodiment made according to the principles of the present invention.

An alternative embodiment of the invention is shown in FIG. 11. In this embodiment, adjustable positioning assemblies 38 and 40 are constructed with slots 57 continued across their fronts. This enables panels 30 and 32 to be arranged in the configuration shown in FIG. 11, thereby permitting loudspeakers 10 and 12 to be used where space available for placement of loudspeakers is restricted or limited. When loudspeakers 10 and 12 are positioned approximately two feet apart, it is possible to create a good stereophonic sound stage. It will be noted that in this acoustic arrangement when the loudspeakers are spaced closely together without benefit of panels 30, 32, the stereophonic sound tends to become monophonic, as can be seen in FIG. 11, with image 98 becoming very dominant. This arrangement provides very little lateral information and does not provide satisfactory stereo separation. Positioning panels 30 and 32 as shown in FIG. 11 however, will overcome this deficiency and provide more than adequate stereo sound staging.

Figure 12:
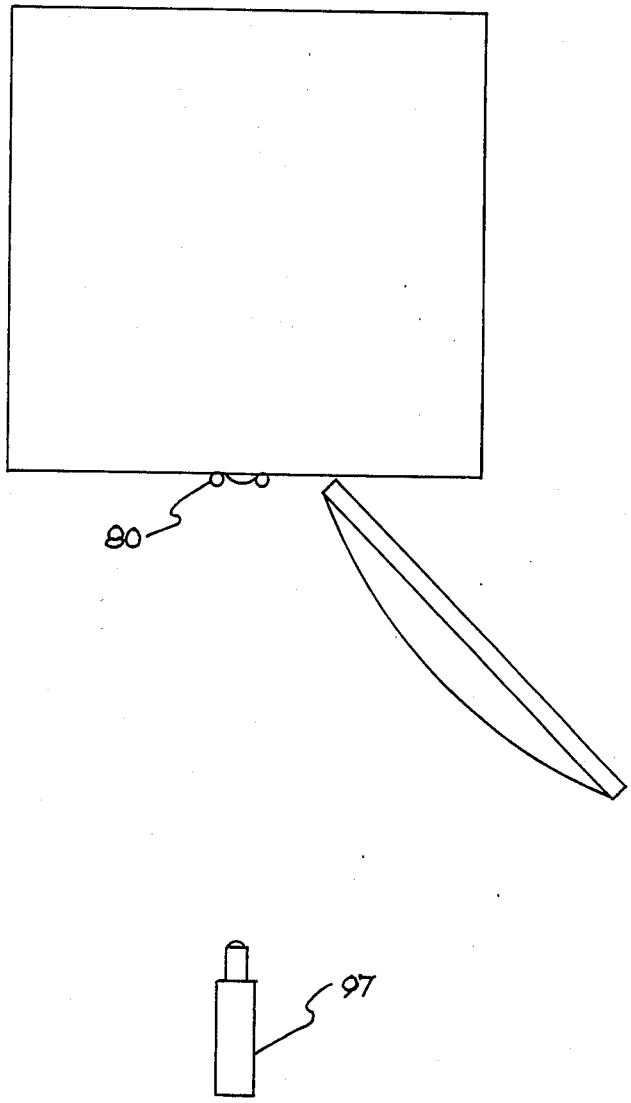
FIG. 12 is a plan view showing the arrangement of a measurement scheme.

FIG. 12 illustrates the measurement set-up used in making the measurements for graphs A and B shown in FIG. 10. Microphone 97 is spaced twelve inches from the face of the speaker and twenty-eight inches from the floor. As shown, torus ring 80 is moved slightly to left of center for the measurements indicated on graph B.

It is apparent from the foregoing that the present invention provides an improved stereophonic imaging system in which two units that are physically separated, radiate overlapping portions of the entire spectrum reproduced to produce a sensation of a single broad source located between the units, while minimizing "beaming" and comb filter effects, and also minimizing reflectance of the radiated sound from adjacent architectural members. In these embodiments, the conic pattern of spherical sound waves form images 90, 92 (see FIG. 1) with sound radiated directly from units 10, 12 respectively, while panels 30, 32 create midrange and high frequency range secondary sound images 94, 96. The radiated sound patterns blend together forming a sound image 98, resulting in a coherent central image with improved definition and fidelity. This phenomenon provides a listener with a sensation of acoustic space and "live sound."

It is evident that those skilled in the art may now make numerous uses and modifications of any departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

I claim:

1. A stereophonic sound system, comprising:

a pair of enclosures positionable in a spaced apart configuration;

each of said enclosures including a pair of electroacoustic transducers operable over overlapping frequency ranges, arranged in vertical symmetry about a common vertical plane;

individual panel means associated with each of said enclosures, for each providing a reflecting surface having a substantially vertical axis; and separate means connectable to different ones of said enclosures for individually positioning each of said panel means with said axis disposed parallel to said common plane at variable distances from and at variable angular orientations to said common plane and with said panel being free to rotate through three hundred and sixty degrees about said vertical axis, whereby each of said panel means is individually positionable with an orientation of said reflective surface relative to the corresponding pair of said transducers to simultaneously redirect energy emanating from both transducers forming each corresponding pair.

2. The system of claim 1, wherein a first one of said transducers in each of said enclosures exhibits a mid-range acoustic frequency response characterized by the occurence of a roll-off region above 2500 Hertz and a second one of said transducers in each of said enclosures exibits an acoustic frequency response partially overlapping and extending substantially above said mid-range frequency response.

3. The system of claim 1, wherein each of said positioning means supports the corresponding one of said panel means with three degrees of freedom accommodating rotation of said member about said axis.

4. The system of claim 2, wherein each of said positioning means supports the corresponding one of said panel means with three degrees of freedom accommodating rotation of said member about said axis.

5. The system of claim 1, wherein each of said positioning means provides the sole support for the corresponding one of said panel means, and includes:

means within and extending from a recess within the corresponding one of said enclosures for slidably varying the separation between the corresponding pair of said transducers and said axis; and means for dampening the resonance of the portion of said varying means included within said recess.

6. The system of claim 2, wherein each of said positioning means provides the sole support for the corresponding one of said panel means, and includes:

means within and extending from a recess within the corresponding one of said enclosures for slidably varying the separation between the corresponding pair of said transducers and said axis; and means for dampening the resonance of the portion of said varying means included within said recess.

7. The system of claim 3, wherein each of said positioning means provides the sole support for the corresponding one of said panel means, and includes:

means within and extending from a recess within the corresponding one of aid enclosures for slidably varying the separation between the corresponding pair of said transducers and said axis; and means for dampening the resonance of the portion of said varying means included within said recess.

8. The system of claim 1, wherein each of said reflecting surfaces exhibits an undulating surface texture.

9. The system of claim 2, wherein each of said reflecting surfaces exhibits an undulating surface texture.

10. The system of claim 3, wherein each of said reflecting surfaces exhibits an undulating surface texture.

11. The system of claim 5, wherein each of said reflecting surfaces exhibits an undulating surface texture.

12. The system of claim 1, wherein each said panel means has a convex reflecting surface formed as a substantially cylindrical are about said axis.

13. The system of claim 1, wherein the outer peripheries of said transducers are mounted flush with the vertical front surfaces of corresponding ones of said enclosures.

14. The system of claim 2, further comprising:

a pair of annular members each having a central axis and each defining an aperture having an interior diameter substantially conforming to the outer diameter of a sound moveable element in each of said second ones of said transducers;

each of said sound moveable elements defining a longitudinal axis; and means for restricting the lateral displacement of the central axes of said annular members from the respective longitudinal axes of said sound moveable elements.

15. A stereophonic sound system component, comprising:

a sound reflecting member having a convex reflecting surface disposed as an arc of a cylinder about a vertical axis;

a pair of electro-acoustic transducers operative over overlapping frequency ranges, mounted in vertical symmery about a common vertical plane parallel to said axis and oriented toward said reflecting member; and means connectable in association with a mounting for said transducers, for positioning said reflecting member with said axis disposed parallel to said common plane at variable distances from and at variable angular orientations to said transducers, whereby said reflecting member is positionable with an orientation of said reflecting surface relative to said transducers to simultaneously redirect energy emanating from both of said transducers.

16. The component of claim 15, wherein a first one of said transducers exhibits a midrange acoustic frequency response characterized by the occurrence of a roll-off region above 2500 Hertz and a second one of said transducers exhibits an acoustic frequency response partially overlapping and extending substantially above said midrange frequency response.

17. The component of claim 15, wherein said positioning means supports said panel member with three degrees of freedom accommodating rotation of said panel member about said axis.

18. The component of claim 15, wherein said positioning means provides the sole support for said panel member, and includes:

mounting means connectable in association with means for mounting said transducers, for engaging said positioning means;

means within and extending from a recess within said mounting means for slidably varying the separation between said transducers and said axis; and means for dampening the resonance of the portion of said varying means included within said recess.

19. The component of claim 15, wherein said convex reflecting surface exhibits an undulating surface texture.

20. The component of claim 15, wherein each said panel means has a convex reflecting surface formed as a substantially cylindrical arc about said axis.

21. The system of claim 16, further comprising:

a pair of annular members each having a central axis and each defining an aperture having an interior diameter substantially conforming to the outer diameter of a sound moveable element in each of said second ones of said transducers;

each of said sound moveable elements defining a longitudinal axis; and means for restricting the lateral displacement of the axes of said annular members from the longitudinal axes of said sound moveable elements.

22. A stereophonic sound system component, comprising:

first transducer means having a first periphery, responsive to a lower frequency range for being driven at acoustic frequencies within the lower frequency range;

second transducer means having a second periphery, responsive to a higher frequency range partially overlapping said lower frequency range, for being driven at acoustic frequencies within the higher frequency range;

means for supporting said first and second transducer means in a common orientation in a vertically symmetric arrangement with said first and second peripheries defining a substantially common plane;

panel means for providing a cylindrical convex reflecting surface having an area exceeding the combined surface area contained within said first and second peripheries, said reflecting surface being symmetrically disposed about a central axis substantially parallel to said common plane; and means extending between said supporting means and said panel means for positioning said panel means vertically across and spaced apart from both said first and second peripheries, with three degrees of freedom about an axis of rotation adjustably spaced apart from said first and second peripheries and substantially parallel to said common plane, whereby said panel means is positionable with an orientation of said reflecting surface relative to said first and second transducer means to simultaneously redirect the energy across all frequency spectra emanating from both said first and second transducer means.

23. A stereophonic sound system component, comprising:

panel means for providing a cylindrical convex reflecting surface having an area exceeding the combined surface area contained within the first and second peripheries of a pair of acoustic frequency transducers, said reflecting surface being symmetrically disposed about a central axis substantially parallel to a common plane definable by the pair of acoustic frequency transducers;

means for supporting said panel means; and means extending between said supporting means and said panel means for positioning said panel means vertically across and spaced apart from both of the first and second peripheries, with three degrees of freedom about an axis of rotation adjustably spaced apart from said first and second peripheries and substantially parallel to said common plane, whereby said panel means is positionable with an orientation of said reflecting surface relative to the first and second transducer means to simultaneously redirect the energy across all frequency spectra emanating from both of the transducers.

* * * * *

UNITED STATES PATENT AND TRADEMARK OFFICE

CERTIFICATE OF CORRECTION

PATENT NO. : 4,701,951

DATED : October 20, 1987

INVENTOR(S) : Albert KASH

It is certified that error appears in the above-identified patent and that said Letters Patent is hereby corrected as shown below: Title page

[56] References Cited

U.S. Patent Documents 1,786,279 - 12/1930 - Wolff
2,610,694 - 9/1952 - DeBoer
2,612,234 - 9/1952 - Ziadinovic
2,896,736 - 7/1959 - Karlson
3,065,816 - 11/1962 - Ranger
3,500,953 - 3/1970 - Lahti
3,765,504 - 10/1973 - Itoh
4,133,975 - 1/1979 - Barker, III
4,190,739 - 2/1980 - Torffield
4,225,010 - 9/1980 - Smith
4,475,620 - 10/1984 - Carlsson Foreign Patents German Patent No. 1,065,467 - September 17, 1959
German Design Patent No. DE 3,132,250 - March, 1983

Other Publications

"Loudspeakers for Stereo", N.H. Crowhurst ELECTRONICS WORLD, pp. 42-44, 74 & 126, May, 1959.

"New Ideas in Stereo Speaker Systems", G.L. Augspurger, RADIO-ELECTRONICS, March, 1959.

University Loudspeakers, Inc. Advertisements, 1959.

"The World of Sound", V.M. Albers, May, 1985.

UNITED STATES PATENT AND TRADEMARK OFFICE

CERTIFICATE OF CORRECTION

PATENT NO. : 4,701,951

DATED : October 20, 1987

INVENTOR(S) : Albert KASH

It is certified that error appears in the above-identified patent and that said Letters Patent is hereby corrected as shown below:

Other Publications, continued

"Fundamentals of Acoustics", L.E. Kinsler et al, 2nd Edition, 1962.

"How to Design, Build & Test Complete Speaker Systems", David B. Weems, TAB BOOKS, INC., 1981

"The Master Handbook of Acoustics", F.A. Everest, TAB BOOKS, INC., 1981, pp. 54-55, 66-67, 92-95, 292-295, 308-311.

"Elementary Hearing Science",L.J. Deutsch et al, UNIVERSITY PARK PRESS, 1979, pp. 120-121.

McIntosh Lab, Inc., 1984 brochure, pp. 53, 56-57.

"The Trimensional Stereo Speaker System", V. Brociner, AUDIO, June, 1959, pp. 21-23.

Undated, unidentified printed publication on "Yamaha NS-10M" and "Allison Six".

Signed and Sealed this

Tenth Day of May, 1988

*Attest:*

*Attesting Officer*

DONALD J. QUIGG

*Commissioner of Patents and Trademarks*